US005170956A

United States Patent [19]

McTaggart

[11] Patent Number: 5,170,956

[45] Date of Patent: Dec. 15, 1992

[54] DISPENSER FOR ROLLED SHEET MATERIAL

[76] Inventor: Willam R. McTaggart, 4630 Pangbuin, Oden, Mich. 49764

[21] Appl. No.: 663,544

[22] Filed: Mar. 4, 1991

[51] Int. Cl.[5] ..... B65H 16/00

[52] U.S. Cl. ..... 242/55.2; 242/75.4; 242/72 R

[58] Field of Search ..... 242/55.54, 55.2, 55.3, 242/72 R, 72 B, 75.4

[56] References Cited

U.S. PATENT DOCUMENTS

| | | | |
|---|---|---|---|
| 2,419,798 | 4/1947 | Stone | 242/55.2 |
| 2,614,770 | 10/1952 | Gabrielson | 403/83 X |
| 2,657,872 | 11/1953 | Lindenmeyer | 242/55.2 |
| 2,889,121 | 6/1959 | Heinle | 242/55.2 |
| 3,620,465 | 11/1971 | Wyatt | 242/55.2 |
| 3,829,147 | 8/1974 | Ryswick | 242/72 X |
| 3,850,379 | 11/1974 | Stern | 242/75.4 X |
| 3,923,265 | 12/1975 | Krueger et al. | 242/55.2 |
| 4,369,929 | 1/1983 | Cayer | 242/55.42 |
| 4,487,376 | 12/1984 | Compton | 242/55.54 |
| 4,720,053 | 1/1988 | Vance | 242/55.2 |
| 4,738,385 | 4/1988 | Bell | 242/55.54 |
| 4,898,335 | 2/1990 | Eysink | 242/55.4 X |

FOREIGN PATENT DOCUMENTS

| | | | |
|---|---|---|---|
| 2401862 | 4/1979 | France | 242/75.4 |

*Primary Examiner*—Daniel P. Stodola
*Assistant Examiner*—John Rollins
*Attorney, Agent, or Firm*—Don J. Flickinger; Jordan M. Meschkow; Lowell W. Gresham

[57] ABSTRACT

A dispenser for rolled sheet material comprises a base, with a mandrel having a free end projecting from the base. The mandrel is receivable in the core to rotatably support the roll of material. A brake mechanism carried by the mandrel responds to longitudinally inwardly directed pressure on the free end of the mandrel by frictionally engaging the core to retard rotation of the roll.

1 Claim, 1 Drawing Sheet

DISPENSER FOR ROLLED SHEET MATERIAL

BACKGROUND OF THE INVENTION

1. Field of the Invention

This invention relates to the art of dispensing.

More particularly, this invention relates to a device for dispensing sheet material In a further and more specific aspect, the instant invention concerns a device for dispensing rolled sheet material and for selectively checking rotation of the roll while an individual sheet is being torn off.

2. Description of the Prior Art

Dispensers for rolled sheet material such as paper towels and toilet paper are widely available. In their simplest form, these dispensers consist of a spindle or mandrel upon which the roll of sheet material is rotatably mounted. Such dispensers may be wall-mounted or adapted to be supported in an upright position on a horizontal surface such as a counter top. When wall-mounted, the mandrel is typically mounted between two support brackets. When adapted for upright use, one end of the mandrel is carried by a base, while the opposite end is free.

A common problem with these simple type dispensers is that even the slightest overexertion when pulling at the free end of the sheet material can result in several feet of material coming unwound from the roll. As a result, users either waste material by tearing off more than they need, or waste time by rewrapping the surplus material around the roll.

In response to the above problem, various attempts have been made to design sheet roll dispensers with braking mechanisms for retarding the unrolling of the material while a single sheet is being torn away. For instance, one prior art dispenser is provided with a sleeve of compressible material disposed between the mandrel and the core of the rolled material. In other prior art dispensers, the mandrel is provided at one end with a gripping member which is movable from a first position spaced from the end of the roll to a second position frictionally engaging the end of the roll, so that a user can check rotation of the roll simply by pushing the member from the first position to the second. Still another prior art dispenser comprises an expansion-type mandrel including an expandable member having four resilient fingers and an expanding member consisting of a knob which is forced into the expandable member to push the four fingers apart, causing them to frictionally engage the core of the sheet material.

Each of the prior art dispensers suffers from at least one shortcoming which has prevented it from attaining widespread success. For instance, in some of the dispensers, the frictional engagement between the braking mechanism and the roll of material can not be regulated, resulting in a disadvantage when the user actually wants to unroll a large amount of material very quickly In other dispensers, the braking mechanisms consist of a large number of small, loose parts which can be easily lost or damaged. Furthermore, in those dispensers where the braking mechanism includes an end piece larger than the diameter of the roll, the end piece must be removed before installing a new roll, thus slowing and complicating the installation process.

It would be highly advantageous, therefore, to remedy the foregoing and other deficiencies inherent in the prior art.

Accordingly, it is an object of the present invention to provide a sheet roll dispenser with an improved braking mechanism for selectively checking rotation of the roll.

Another object of the invention is the provision of a sheet roll dispenser which can be operated in either a vertical or horizontal position.

And another object of the invention is to provide a cantilevered sheet roll dispenser which allows rolls to be conveniently installed and removed using only one hand.

Still another object of the invention is the provision of a braking mechanism for a sheet roll dispenser wherein the amount of frictional resistance provided by the mechanism can be selectively regulated.

Yet another object of the invention is to provide a sheet roll dispenser with a sturdy, durable braking mechanism requiring a minimal number of parts.

Yet still another object of the invention is the provision of a braking mechanism for a sheet roll dispenser which also serves as a spring for normally maintaining the dispenser in a relatively frictionless configuration.

And a further object of the invention is to provide a sheet roll dispenser having a two-piece mandrel wherein a braking action is obtained by reciprocating one of the mandrel pieces relative to the other piece.

And still a further object of the invention is the provision of a sheet roll dispenser, according to the foregoing, which is relatively inexpensive to manufacture and comparatively simple and easy to use.

SUMMARY OF THE INVENTION

Briefly, to achieve the desired objects of the instant invention in accordance with the preferred embodiment thereof, an improved dispenser is provided for rotatably supporting a roll of sheet material and for selectively checking rotation of the roll.

The dispenser comprises a base, with a mandrel having a free end and projecting from the base to define a longitudinal axis. The mandrel is receivable within the core to rotatably support the roll of sheet material Brake means are carried by the mandrel for momentary frictional engagement with the core of the roll in response to longitudinally inwardly directed pressure applied to the free end of the mandrel.

More specifically, the mandrel comprises a stationary section affixed to the base, and a movable section mounted for longitudinal reciprocation relative to the stationary section. The braking means comprises a resilient, elastically deformable member mounted between a first transversely extending shoulder formed on the stationary section of the mandrel and a second shoulder formed on the movable section. When the movable section is pressed toward the stationary section, the deformable member is compressed in the direction of the longitudinal axis of the mandrel, and expanded in the transverse direction. The transverse expansion causes the deformable member to frictionally engage the core of the rolled material, thus allowing selective checking of the rotation of the roll. When the movable section is released, the deformable member springs back into its normal shape, allowing free rotation of the roll.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which.

DETAILED DESCRIPTION OF THE PREFERRED EMBODIMENT

Figure 1:
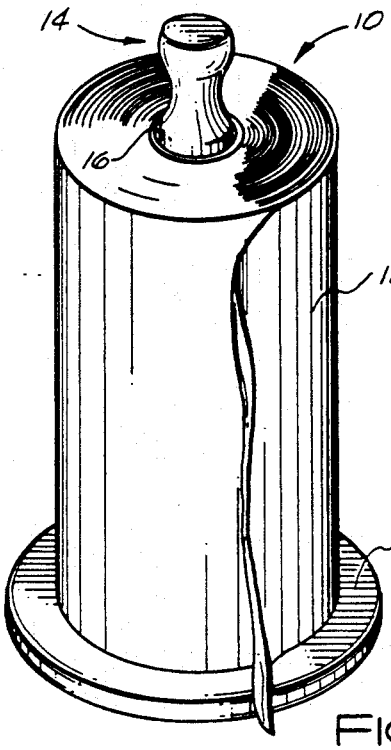
FIG. 1 is a perspective view showing a dispenser according to the instant invention, with a roll of paper towels mounted thereon.
Figure 4:
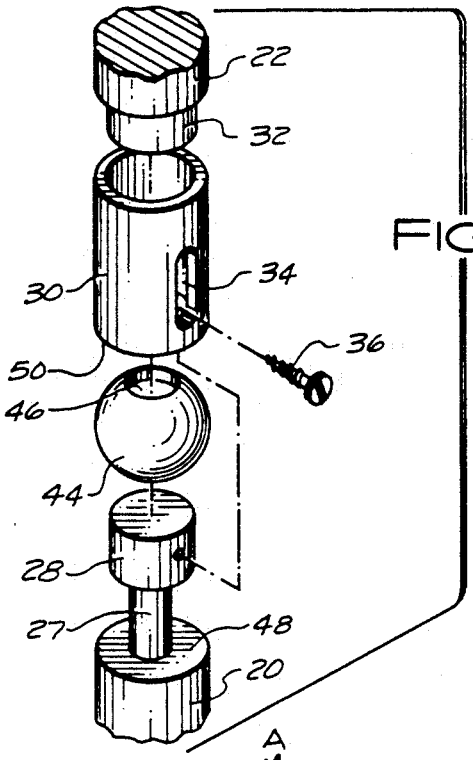
FIG. 4 is a fragmentary perspective view, showing the elements of the braking mechanism in exploded relation to one another.

Turning now to the drawings in which like reference characters indicate corresponding elements throughout the several views, attention is first directed to FIG. 1, which shows the dispenser 10 supported in an upright position on a horizontal surface such as a counter top. The dispenser 10 comprises a base 12 and a mandrel 14 which projects from the base 12 and extends through the hollow core 16 of a roll 18 of sheet material such as paper towels. The base 12 is formed from a material having a smooth outer surface so that friction between the base 12 and the bottom end of the roll 18 is minimal.

Figure 2:
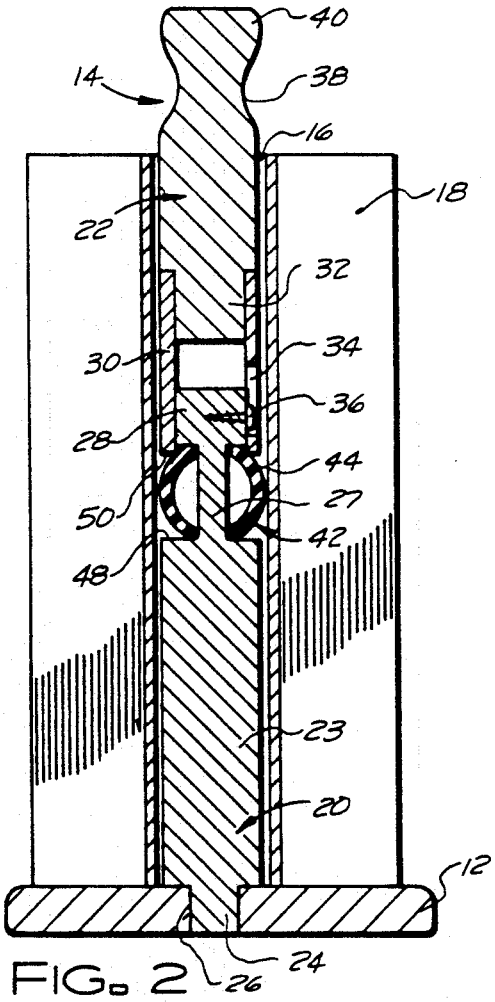
FIG. 2 is a longitudinal sectional view of the dispenser shown in FIG. 1, showing the braking mechanism in a relaxed configuration.

As shown more clearly in FIG. 2, the mandrel 14 comprises two sections. The lower section 20 is stationary and defines a longitudinal axis generally coinciding with the longitudinal axis of the core 16 of the roll 18. The upper section 22 is mounted for reciprocation along the longitudinal axis relative the lower section 20.

In the illustrated embodiment, the lower end of lower section 20 includes a main body 23 and a reduced diameter portion 24, which is press fitted into an aperture 26 in the base 12. Reduced diameter portion 24 and aperture 26 could also be threaded, or other conventional connectors such as metal screws, bolts and the like could also be used.

The upper end of lower section 20 includes a neck 27 and a terminal boss 28, the diameter of which is greater than that of neck 27 but less than that of main body 23. The terminal boss 28 is slidably received in a sleeve 30 depending from the lower end of upper section 22. The upper end of the sleeve 30 is secured to a reduced diameter portion 32 on the lower end of upper section 22 by means of a press fit. The lower end of the sleeve 30 includes an elongated slot 34 through which the enlarged head of a screw 36 carried by lower section 20 projects The lower end of the slot 34 acts as a stop against which the head of screw 36 abuts, thus limiting the distance which upper section 22 can travel upwardly relative to lower section 20 thereby preventing separating therebetween.

The downward movement of upper section 22 is limited by the abutment of the end thereof against the end of lower section 20, thereby eliminating any strain upon screw 36.

The upper end of upper section may include a recessed portion 38 and a flattened top portion 40. The recessed portion 38 serves as a convenient hand grip, while the flattened top 40 allows a user to press down on the mandrel with a forearm if his or her hands are wet or greasy. The diameter of the rounded top portion 40, like that of the rest of the mandrel 14, should be less than the diameter of the core 16 of roll 18, to allow simple, one-handed installation and replacement of the roll. However, if the user wishes to mount the dispenser 12 horizontally on a vertical surface such as a wall, rather than on a horizontal surface as shown, it would be advisable to provide top portion 40 with a removable cap of larger diameter than the core 16 for preventing the roll 18 from sliding off the mandrel.

Interposed between stationary lower section 20 and movable upper section 22 of the mandrel is a braking mechanism 42 for selectively checking rotation of the roll 18. The braking mechanism 42 consists of a hollow rubber ball 44 carried by the neck 27 of lower section 20. The ball 44 has a diameter slightly less than the diameter of the core 16 of the roll 18, and is formed with a bore 46. When the ball 44 is unstressed, the diameter of the bore 46 is preferably equal to the diameter of the neck 27 at the bottom of the ball 44, but slightly greater at the top, to allow the top portion of the ball 44 to slide freely down the neck 27 without crimping. It is preferred that bore 46 frictionally engage the lower end of neck 27 to prevent longitudinal movement of ball 44. The resilience of the ball must be sufficient to allow the diameter of the bore 46 to be stretched to fit over the boss 28 during installation, and then to return to its normal size.

The transition area between main body 23 and neck 27 of the lower section 20 extends transverse to the longitudinal axis of the mandrel, thus defining a first shoulder 48 which supports the ball 44. The bottom rim of the sleeve 30 depending from upper section 22 defines a second shoulder 50. Normally, the spacing between first shoulder 48 and second shoulder 50 is approximately equal to the diameter of the ball 44, so that the ball is unstressed, as shown in FIG. 2.

Figure 3:
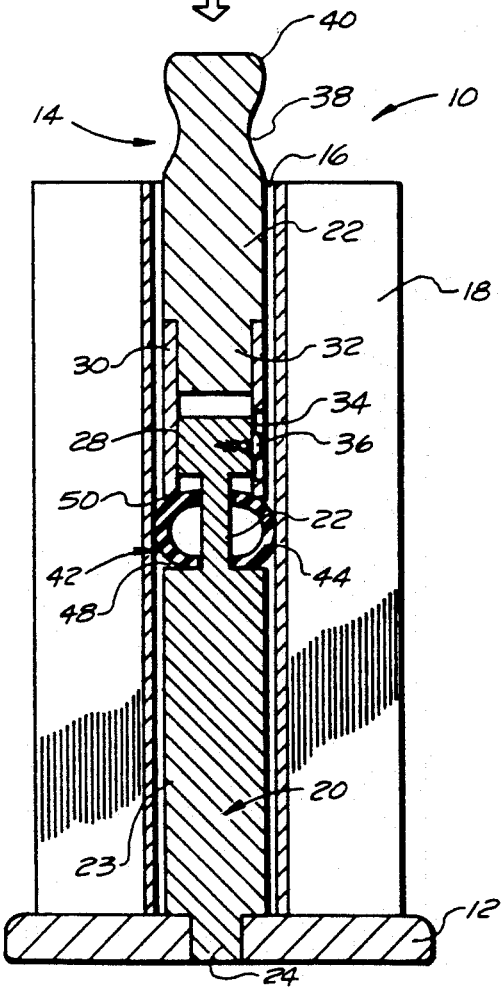
FIG. 3 is a view similar to FIG. 2, showing the braking mechanism being activated to frictionally engage the core of the paper towel roll.

When the upper section 22 of the mandrel 14 is pressed longitudinally inwardly, as shown by the arrow A in FIG. 3, the second shoulder 50 is pressed into the ball 44, thus causing the ball 44 to be compressed in the direction of the pressure and to expand in the transverse direction. The transverse expansion causes the ball to frictionally engage the core 16, thus impeding rotation of the roll. The amount of frictional resistance, and therefore the speed of rotation, can be controlled very simply by regulating the amount of pressure the user exerts against the mandrel 14. When pressure is removed altogether, the natural resilience of the ball 44 causes it to return to its spherical configuration, allowing the roll 18 to be spun freely, and urging upper section 22 of mandrel 14 back to its uppermost position, in which the head of screw 36 abuts the lower end of slot 34, as shown in FIG. 2.

Various modifications and variations to the embodiments herein chosen for purposes of illustration will readily occur to those skilled in the art. To the extent that such variations and modifications do not depart from the spirit of the invention, they are intended to be included within the scope thereof which is assessed only by a fair interpretation of the following claims.

Having fully described and disclosed the instant invention and alternately preferred embodiments thereof in such clear and concise terms as to enable those skilled in the art to understand and practice the same, the invention claimed is:

1. A dispenser for rotatably supporting a roll of sheet material having a hollow core and for selectively checking rotation of said roll, said dispenser comprising:

a) a base;

b) a mandrel projecting from said base having a longitudinal axis and terminating with a free end, said mandrel receivable within the core for rotatably supporting said roll and having, i) a stationary section projecting from said base including a first shoulder extending generally transverse to said longitudinal axis, ii) a moveable section reciprocally moveable along said longitudinal axis relative to said stationary section including a second shoulder opposing said first shoulder, c) an elastically deformable spherical ball formed of resilient material and having an outer diameter less than the inner diameter of the core of said roll when said ball is unstressed, disposed between said shoulders and configured to compress in the direction of the longitudinal axis of said mandrel and expand in the transverse direction in response to movement of said second shoulder toward said first should in response to longitudinally directed pressure applied to the free end of said mandrel.

* * * * *

UNITED STATES PATENT AND TRADEMARK OFFICE

CERTIFICATE OF CORRECTION

PATENT NO. : 5,170,956

DATED : 15 December 1992

INVENTOR(S) : William R. McTaggart

It is certified that error appears in the above-identified patent and that said Letters Patent is hereby corrected as shown below:

In claim 1, column 6, line 9, change "should" to --shoulder--.

Signed and Sealed this

Twelfth Day of October, 1993

*Attest:*

*Attesting Officer*

BRUCE LEHMAN

*Commissioner of Patents and Trademarks*